US011116321B2

(12) United States Patent
Ritter et al.

(10) Patent No.: US 11,116,321 B2
(45) Date of Patent: Sep. 14, 2021

(54) SOFA BED

(71) Applicant: Winnebago Industries Inc., Forest City, IA (US)

(72) Inventors: Robert Ritter, Clear Lake, IA (US); Robin Adams, Forest City, IA (US)

(73) Assignee: Winnebago Industries, Inc., Forest City, IA (US)

( * ) Notice: Subject to any disclaimer, the term of this patent is extended or adjusted under 35 U.S.C. 154(b) by 480 days.

(21) Appl. No.: 15/789,626

(22) Filed: Oct. 20, 2017

(65) Prior Publication Data

US 2018/0116410 A1 May 3, 2018

Related U.S. Application Data

(60) Provisional application No. 62/415,764, filed on Nov. 1, 2016.

(51) Int. Cl.
*A47C 17/213* (2006.01)
*A47C 17/207* (2006.01)
*A47C 17/165* (2006.01)

(52) U.S. Cl.
CPC ..... *A47C 17/213* (2013.01); *A47C 17/165* (2013.01); *A47C 17/2076* (2013.01)

(58) Field of Classification Search
CPC . A47C 17/213; A47C 17/165; A47C 17/2076; A47C 17/02; A47C 17/37; A47C 17/207; A47C 17/20
USPC ..... 5/44.1
See application file for complete search history.

(56) References Cited

U.S. PATENT DOCUMENTS

| | | | | |
|---|---|---|---|---|
| 891,351 | A | 6/1908 | Mayer | |
| 1,381,293 | A | 6/1921 | Freeman | |
| 1,811,936 | A | 6/1931 | Hutchins | |
| 2,080,474 | A * | 5/1937 | Hallberg | A47C 17/1756 5/24 |
| 2,126,588 | A | 8/1938 | Thum | |
| 2,287,596 | A | 6/1942 | Bell | |
| 2,291,391 | A | 7/1942 | Krakauer | |
| 2,534,175 | A | 12/1950 | Lorenz | |
| 2,582,904 | A | 1/1952 | Williard | |
| 2,602,169 | A | 7/1952 | McDaniel | |
| 2,634,430 | A | 4/1953 | Weigand | |
| 2,664,145 | A | 12/1953 | Creveling et al. | |
| 2,664,574 | A | 1/1954 | Newborn | |
| 2,740,131 | A * | 4/1956 | Vogel | A47C 17/2076 5/42 |

(Continued)

FOREIGN PATENT DOCUMENTS

| | | | |
|---|---|---|---|
| EP | 477148 | A1 | 3/1992 |
| EP | 1230877 | A1 | 8/2002 |

(Continued)

*Primary Examiner* — Nicholas F Polito
*Assistant Examiner* — Luke Hall
(74) *Attorney, Agent, or Firm* — Faegre Drinker Biddle & Reath LLP

(57) ABSTRACT

A sofa bed is configured to be switched between a sofa configuration and a bed configuration. The sofa bed includes a base frame, a middle frame rotatably coupled to the base frame, a seat-and-foot frame rotatably coupled to the middle frame, a back-and-head frame rotatably coupled to the base frame, and a spring coupled between at least two of the base frame, the middle frame, the seat-and-back frame, and the back-and-head frame.

14 Claims, 10 Drawing Sheets

(56) References Cited

U.S. PATENT DOCUMENTS

| | | | | |
|---|---|---|---|---|
| 2,749,559 | A * | 6/1956 | Petersen | A47C 17/225 5/13 |
| 3,085,257 | A | 4/1963 | Laemmle | |
| 3,277,503 | A * | 10/1966 | Steffan | A47C 17/225 5/31 |
| 3,317,930 | A | 5/1967 | Wiberg | |
| 3,345,651 | A | 10/1967 | Fox | |
| 3,432,203 | A | 3/1969 | Cavalli | |
| 4,074,371 | A | 2/1978 | Lindbloom | |
| 4,204,287 | A | 5/1980 | Hauck et al. | |
| 4,321,717 | A | 3/1982 | Serra | |
| 4,365,369 | A | 12/1982 | Plume | |
| 4,402,096 | A | 9/1983 | Atimichuk | |
| 4,512,048 | A | 4/1985 | Isham et al. | |
| 4,625,346 | A | 12/1986 | Quackenbush | |
| 4,639,953 | A | 2/1987 | McElmurry et al. | |
| 4,672,696 | A | 6/1987 | Horenkamp | |
| 5,097,544 | A | 3/1992 | Barabas | |
| 5,231,710 | A | 8/1993 | Markel et al. | |
| 5,479,665 | A | 1/1996 | Cassidy et al. | |
| 5,595,513 | A | 1/1997 | Kondo | |
| 5,745,935 | A | 5/1998 | Arft | |
| 5,787,522 | A | 8/1998 | Swihart | |
| 5,904,401 | A | 5/1999 | Alberda et al. | |
| 6,082,805 | A | 7/2000 | Gray et al. | |
| 6,341,392 | B1 | 1/2002 | Mäkinen | |
| 6,651,274 | B2 | 11/2003 | Swihart et al. | |
| 6,725,473 | B2 | 4/2004 | Grossman | |
| 6,904,628 | B2 | 6/2005 | Murphy et al. | |
| 7,685,655 | B1 | 3/2010 | Delmestri | |
| 7,748,061 | B2 | 7/2010 | Pine | |
| 7,827,629 | B1 | 11/2010 | Guillot | |
| 8,011,034 | B2 | 9/2011 | Hoffman et al. | |
| 8,438,676 | B2 * | 5/2013 | Murphy | A47C 3/16 5/35 |
| 9,173,502 | B2 | 11/2015 | Smith et al. | |
| 9,357,850 | B2 * | 6/2016 | Murphy | A47C 17/04 |
| 9,622,587 | B2 * | 4/2017 | Murphy | A47C 7/402 |
| 2004/0100114 | A1 * | 5/2004 | Rhodes | B60N 2/3075 296/65.09 |
| 2010/0269255 | A1 | 10/2010 | Kanthasamy | |
| 2014/0265077 | A1 * | 9/2014 | Hinks | F16F 3/10 267/151 |

FOREIGN PATENT DOCUMENTS

| | | | |
|---|---|---|---|
| FR | 2488116 | A1 | 2/1982 |
| FR | 2699798 | A1 | 7/1994 |
| FR | 2895655 | A1 | 7/2007 |
| GB | 322522 | A | 12/1929 |
| GB | 358338 | A | 10/1931 |
| GB | 365766 | A | 1/1932 |
| GB | 366171 | A | 2/1932 |
| GB | 819933 | | 9/1959 |
| GB | 823014 | A | 11/1959 |
| GB | 2079147 | A | 1/1982 |

* cited by examiner

SOFA BED

CROSS-REFERENCE TO RELATED APPLICATIONS

This application claims priority to Provisional Application No. 62/415,764 filed Nov. 1, 2016, which is herein incorporated by reference in its entirety.

BACKGROUND

Existing sofa beds rely solely on user force to move between a sofa configuration and a bed configuration. Further, existing sofa beds do not provide a uniform sleeping surface in the bed configuration. For example, in the bed configuration, center sections of the sofa bed are thinner than other sections resulting in inconsistent firmness across the sleeping surface. As such, there is a need for improved sofa beds.

SUMMARY

In certain embodiments, a sofa bed includes a base frame, a middle frame rotatably coupled to the base frame, a seat-and-foot frame rotatably coupled to the middle frame, a back-and-head frame rotatably coupled to the base frame, a spring coupled between at least two of the base frame, the middle frame, the seat-and-back frame, and the back-and-head frame. The sofa bed is configured to be positioned between a sofa configuration and a bed configuration.

DETAILED DESCRIPTION

The various embodiments disclosed or contemplated herein relate to sofa beds that can switch between a sofa configuration and a bed configuration. The sofa beds include a spring coupled to certain sections of the sofa bed to assist a user in switching the sofa bed between the sofa configuration and the bed configuration. Further, the disclosed sofa beds are arranged such that, in the bed configuration, the sofa beds provide a level sleeping surface.

Figure 1:
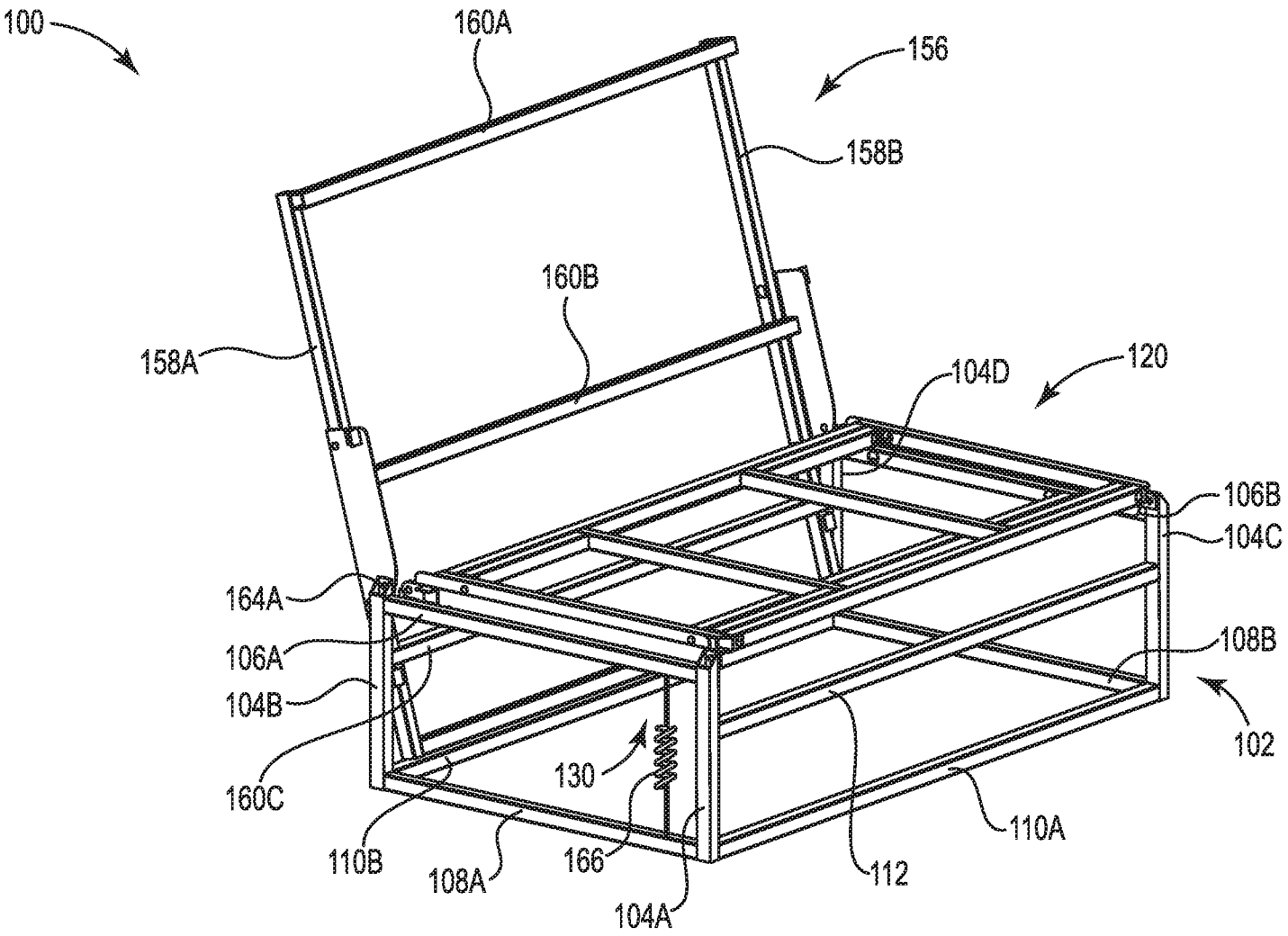
FIG. 1 shows a perspective view of a sofa bed without cushions, in accordance with certain embodiments of the present disclosure.

FIG. 1 shows a perspective view of a sofa bed 100 without cushions, and FIGS. 2A-E show the sofa bed 100 with cushions. In FIG. 1, the sofa bed 100 is positioned in a sofa configuration, and in FIG. 2E, the sofa bed 100 is positioned in the bed configuration.

The sofa bed 100 includes a base frame 102 with four legs (a first leg 104A, a second leg 104B, a third leg 104C, and a fourth leg 104D); a first top crossbar 106A between the first leg 104A and the second leg 104B; a second top crossbar 106B between the third leg 104C and the fourth leg 104D; a first bottom crossbar 108A between the first leg 104A and the second leg 104B; a second bottom crossbar 108B between the third leg 104C and the fourth leg 104D; a first bottom longitudinal bar 110A between the first leg 104A and the third leg 104C; a second bottom longitudinal bar 110B between the second leg 104B and the fourth leg 104D; and a first middle longitudinal bar 112 between the first leg 104A and the third leg 104C.

Figure 2A:
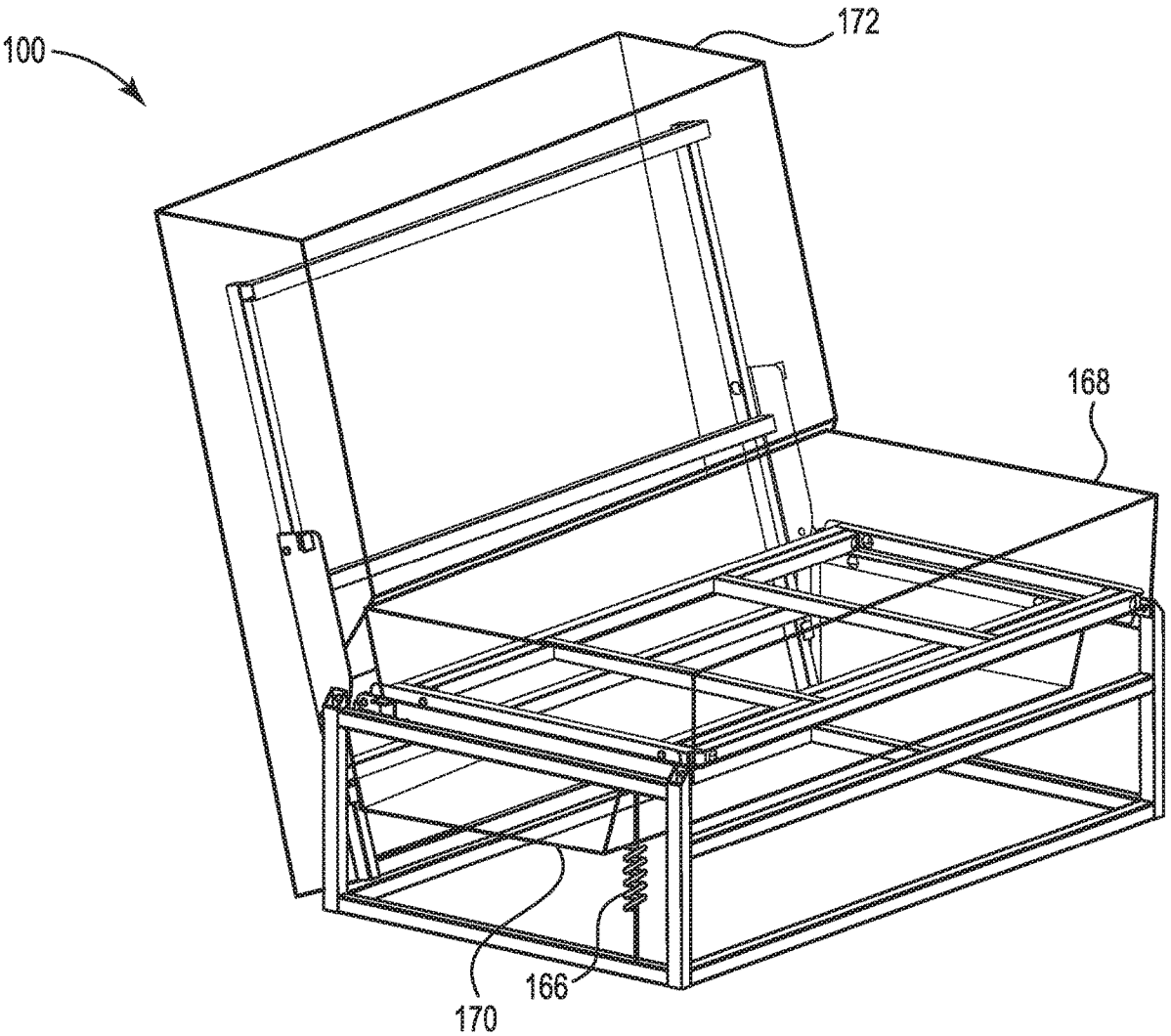
FIG. 2A shows a perspective view of the sofa bed of FIG. 1 with cushions and in a sofa configuration.
Figure 2B:
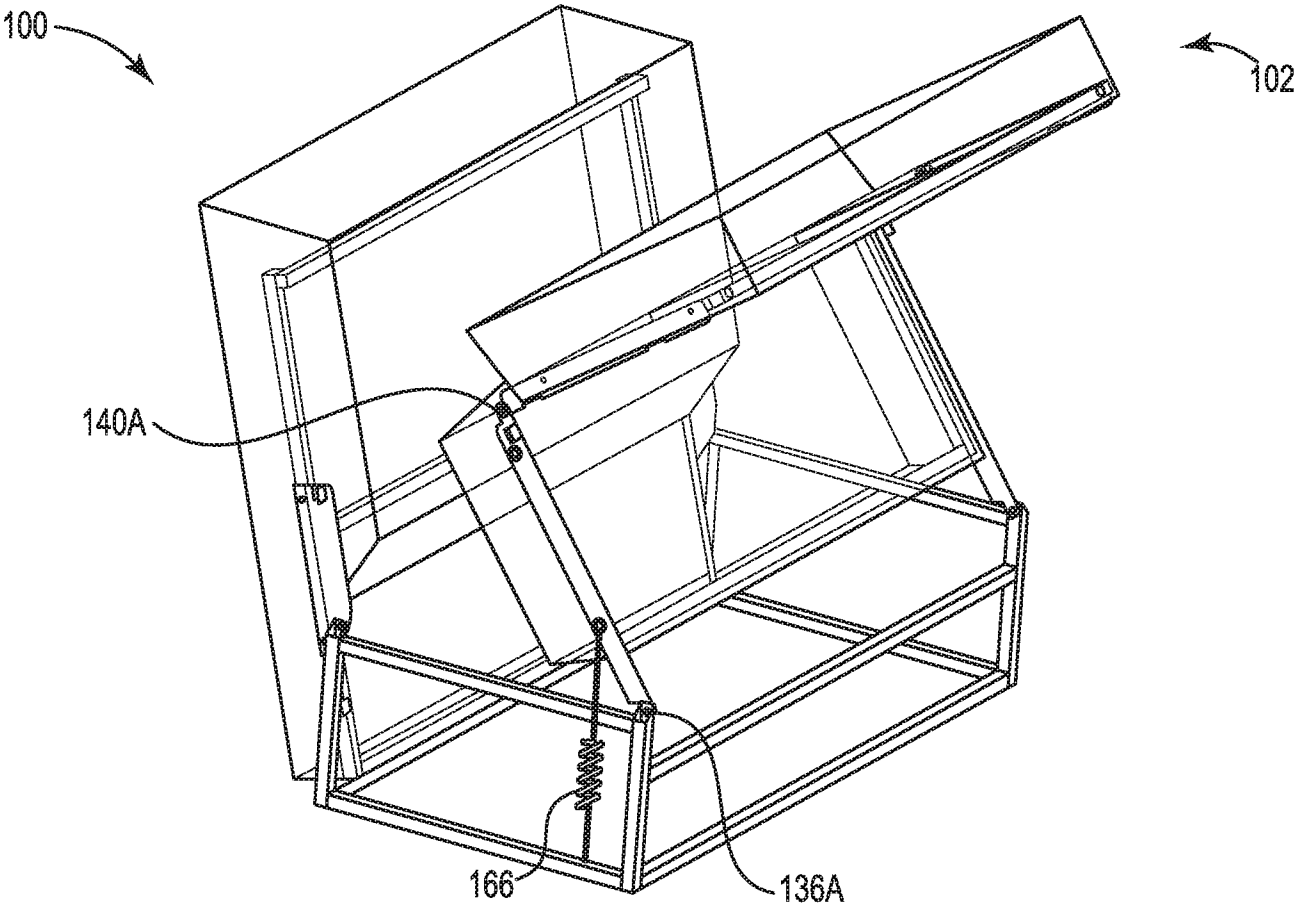
FIGS. 2B-D show perspective views of the sofa bed of FIG. 1 with cushions and in various stages between the sofa configuration and a bed configuration.
Figure 2C:
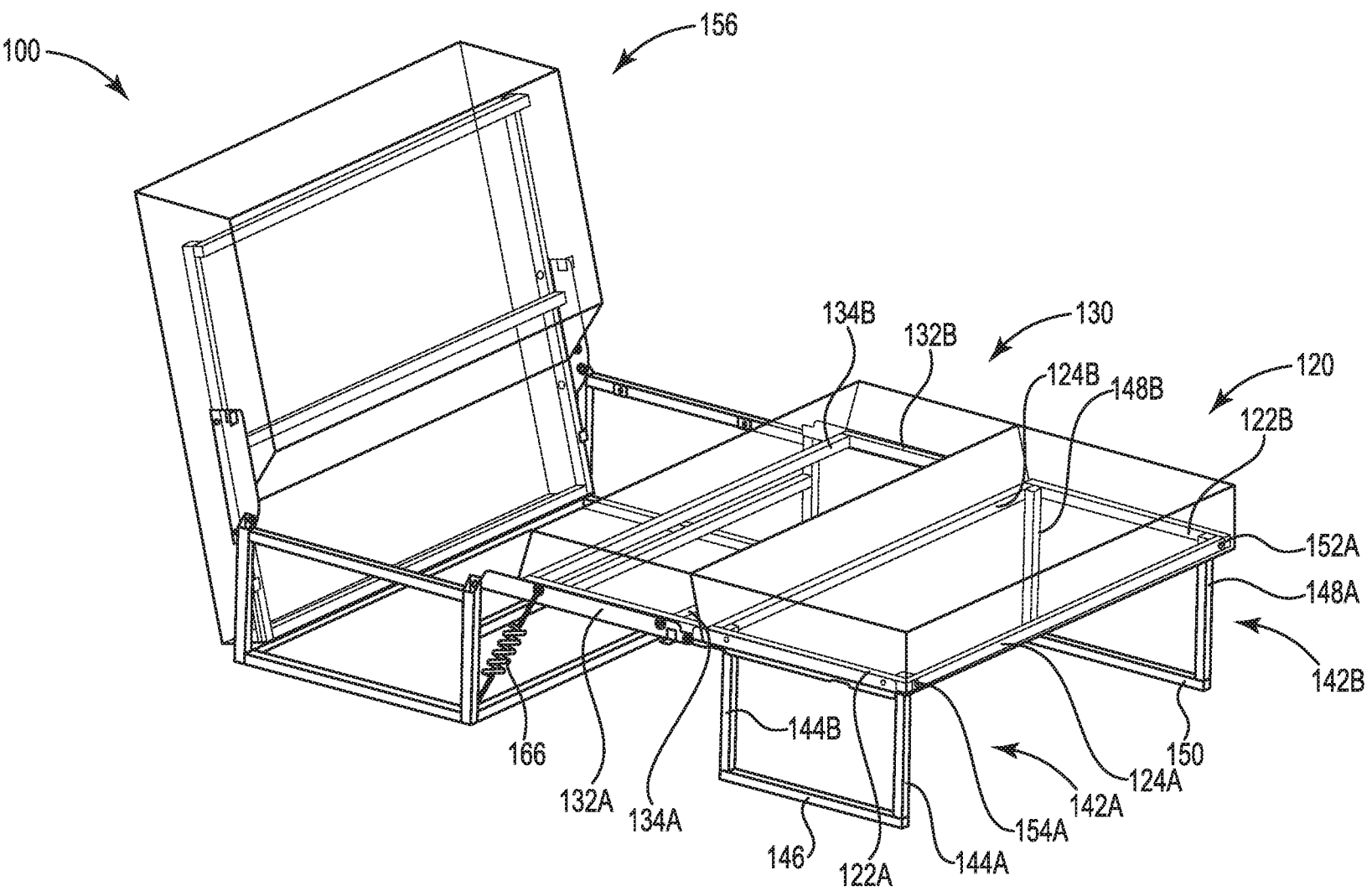
Figure 2D:
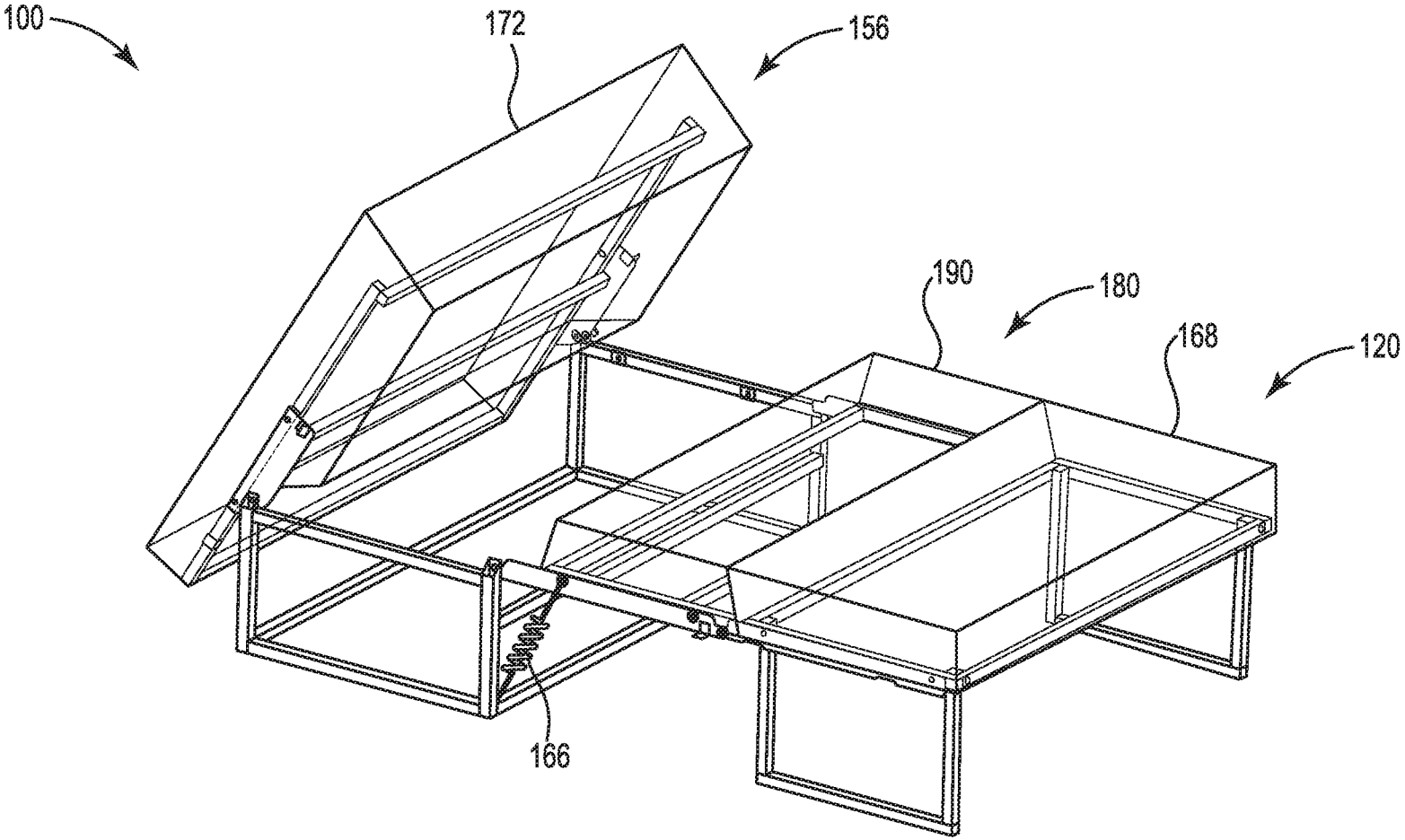
Figure 2E:
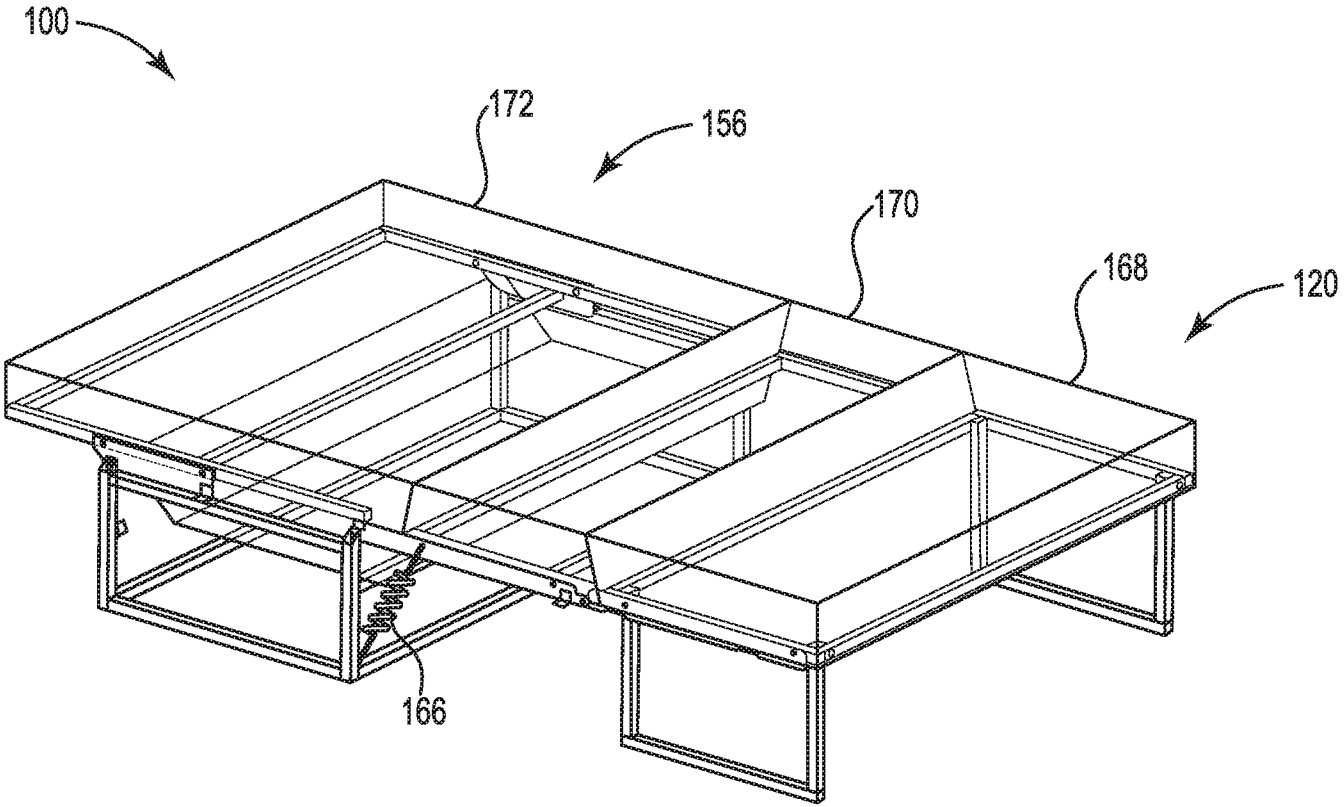
FIG. 2E shows a perspective view of the sofa bed of FIG. 1 with cushions and in the bed configuration.

The sofa bed 100 includes a first section frame 120, which can be referred to as a seat-and-foot frame. The first section frame 120 includes a first crossbar 122A and a second crossbar 122B and a first longitudinal bar 124A and a second longitudinal bar 124B (as shown in FIG. 2C).

The sofa bed 100 also includes a second section frame 130, which can be referred to as a middle frame. The second section frame 130 has a first crossbar 132A, a second crossbars 132B, a first longitudinal bar 134A, a second longitudinal bar 134B (as shown in FIG. 2C). The second section frame 130 is hingedly coupled to the base frame 102 via a first hinge 136A and a second hinge (not shown).

The first section frame 120 is hingedly coupled to the second section frame 130 via a first hinge 140A and a second hinge (not shown). The first section frame 120 is also coupled to a first deployable section member 142A and a second deployable section member 142B (see FIG. 2C). The first deployable section member 142A has a first leg 144A, a second leg 144B, and a first crossbar 146 that extends between the first leg 144A and the second leg 144B. Similarly, the second deployable section member 142B has a first leg 148A, a second leg 148B, and a first crossbar 150 that extends between the first leg 148A and the second leg 148B. The first deployable section member 142A is hingedly coupled to the first section frame 120 via a first hinge 152A and a second hinge (not shown), while the second deployable section member 142B is hingedly coupled to the first section frame 120 via a first hinge 154A and a second hinge (not shown).

The sofa bed 100 also includes a third section frame 156, which can be referred to as a back-and-head frame. The third section frame 156 has a first crossbar 158A, a second crossbar 158B, a first longitudinal bar 160A, a second longitudinal bar 160B, a third longitudinal bar 160C, a first extension bar 162A, and a second extension bar 162B. The third section frame 156 is hingedly coupled to the base frame 102 via a first hinge 164A and a second hinge 164B.

In certain embodiments, the sofa bed 100 includes a spring 166 (shown in FIG. 1) coupled between the base frame 102 and the second section frame 130. The spring 166 is arranged to apply a force that provides assistance to a user while the user switches the sofa bed 100 between the bed configuration and the sofa configuration. In certain embodiments, the spring 166 is coupled at one end to one of the four legs 104A, 104B, 104C, and 104D of the base frame 102 and at the other end to the first crossbar 132A or the first longitudinal bar 134A of the second section frame 130 such that the spring 166 applies an upward force to the second section frame 130 that reduces an amount of force required by the user to urge the second section frame 130 to rotate between the sofa configuration and the bed configuration. In certain embodiments, the spring 166 is a compression spring such as a gas compression spring. In certain embodiments, the spring 166 is any known spring or similar mechanism that can assist the user in moving the sofa bed between the sofa configuration and the bed configuration.

In use, a user can switch the sofa bed 100 between the sofa configuration (see FIG. 1) and the bed configuration (see FIG. 2E) by rotating the first section frame 120, the second section frame 130, and the third section frame 156 as described herein. As shown in FIGS. 2A-E, the first section frame 120 is coupled to a foot cushion 168, the second section frame 130 is coupled to a middle cushion 170, and the third section frame 156 is coupled to a head-and-back cushion 172. In the sofa configuration, the second section frame 130 and middle cushion 170 serve as a seat of the sofa bed 100 while the third section frame 156 and head-and-back cushion 172 is used as the back of the sofa bed 100.

To convert the sofa bed 100 into the bed configuration, a user first lifts the first section frame 120 and urges it upward such that the first section frame 120 rotates with respect to the second section frame 130 around the first hinge 140A and the respective second hinge. As the user continues to urge the first section frame 120 upward and forward, the second section frame 130 is also urged upward and rotates with respect to the base frame 102 around the first hinge 138A and the respective second hinge to allow the second section frame 130 to move upward away from the base frame 102.

In certain embodiments, as the first section frame 120 and the second section frame 130 extend forward, the first deployable section member 142A and the second deployable section member 142B are automatically urged to rotate around the first hinge 152A and the respective second hinge such that the first deployable section member 142A and the second deployable section member 142B provide support for the first section frame 120.

Once the first section frame 120 and the second section frame 130 are positioned, the user can rotate the third section frame 156 from an upright position to a down position. Once the first section frame 120, the second section frame 130, and the third section frame 156 are positioned in their bed configuration position, the frames are positioned adjacent to each other such that top surfaces of the frames are aligned in a uniformly flat top surface.

Figure 3:
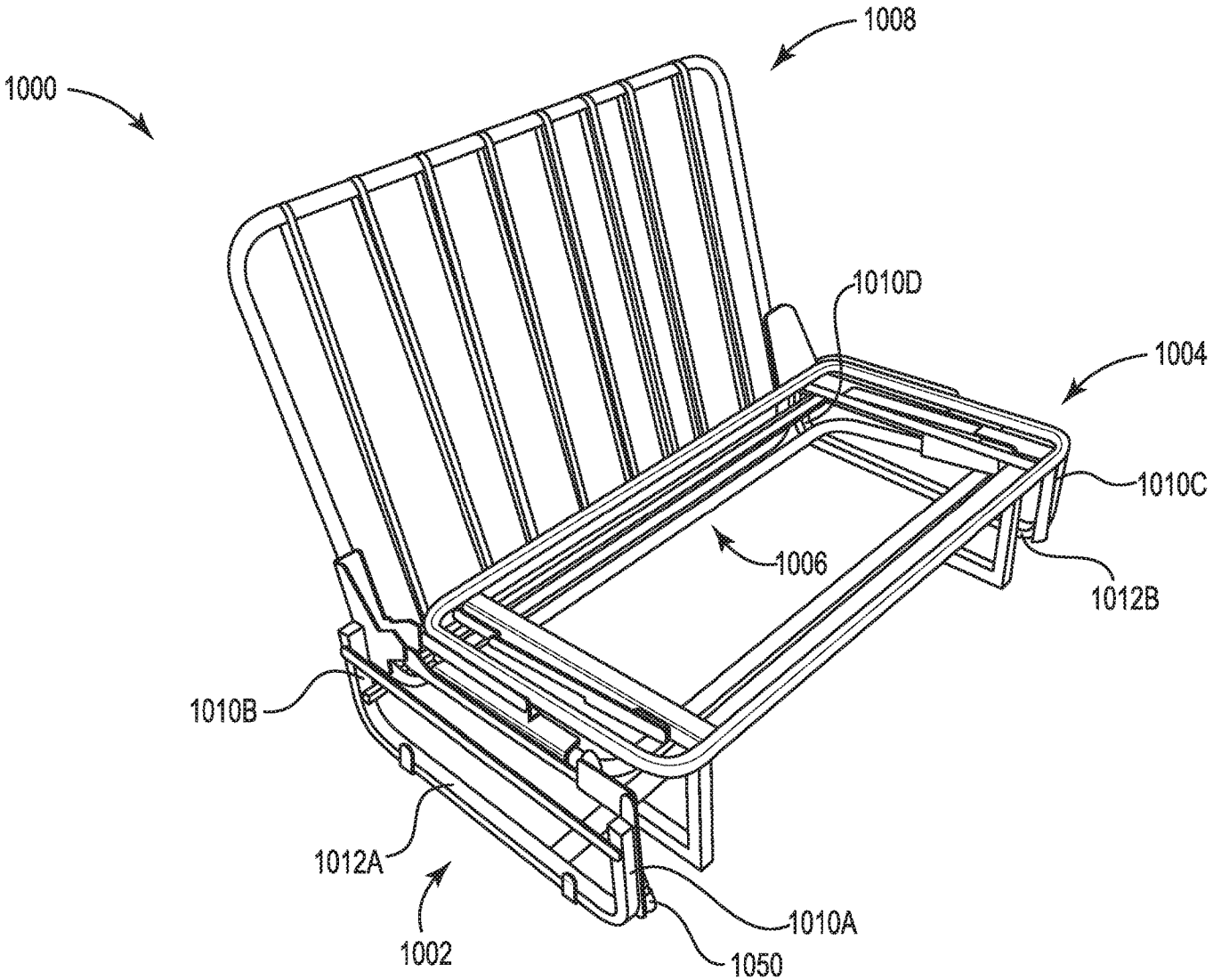
FIG. 3 shows a perspective view of a sofa bed without cushions and in a sofa configuration, in accordance with certain embodiments of the present disclosure.
Figure 4:
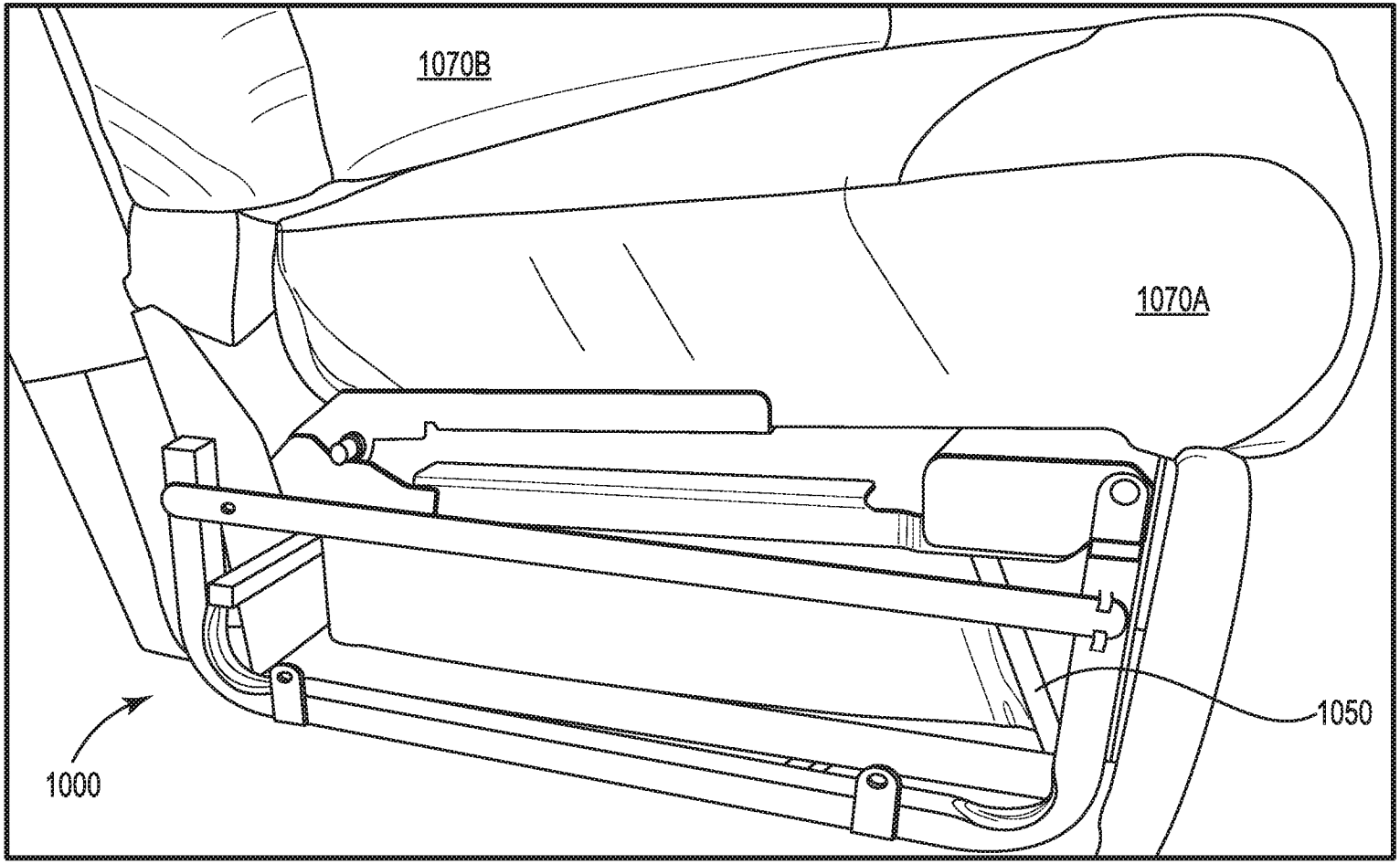
FIG. 4 shows a side view of a portion of the sofa bed of FIG. 3 with cushions.
Figure 5:
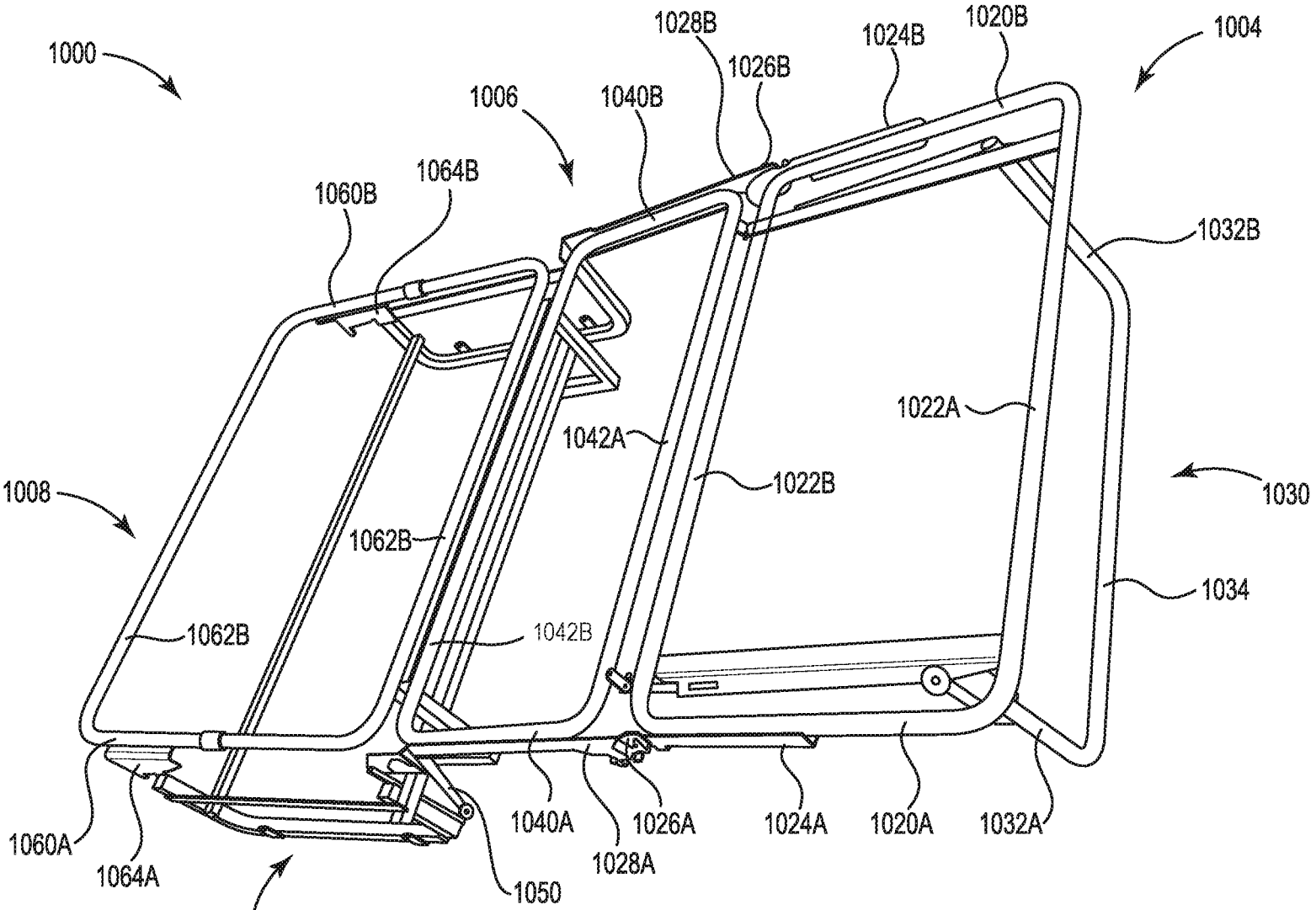
FIG. 5 shows a perspective view of the sofa bed of FIG. 3 in a bed configuration.

FIGS. 3-5 show a sofa bed 1000 including a base frame 1002, a first section frame 1004, a second section frame 1006, and a third section frame 1008.

The base frame 1002 includes four legs 1010A, 1010B, 1010C, and 1010D; a first middle crossbar 1012A between the first leg 1010A and the second leg 1010B; a second middle crossbar 1012B between the third leg 1010C and the fourth leg 1010D; a first bottom crossbar 1014A between the first leg 1010A and the second leg 1010B; a second bottom crossbar 1014B between the third leg 1010C and the fourth leg 1010D; a first bottom longitudinal bar 1016A between the first leg 1010A and the third leg 1010C.

The first section frame 1004 has a first crossbar 1020A, a second crossbar 1020B, a first longitudinal bar 1022A, and a second longitudinal bar 1022B. Further, the first section frame 1004 is coupled to (or integral with) a first extension bar 1024A and a second extension bar 1024B that are each coupled to or disposed on an outer portion of the first crossbar 1020A and the second crossbar 1020B. The first section frame 1004 is hingedly coupled to the second section frame 1006 via the first extension bar 1024A and the second extension bar 1024B. More specifically, the first extension bar 1024A and the second extension bar 1024B are coupled to a first hinge 1026A and a second hinge 1026B, which are, in turn, coupled to a first extension bar 1028A and a second extension bar 1028B that are coupled to (or integral with) the second section frame 1006.

In addition, the first section frame 1004 has a deployable section support 1030. In certain embodiments, the deployable section support 1030 of the first section frame 1004 can automatically deploy as the first section frame 1004 and the second section frame 1006 are moved from the sofa configuration to the bed configuration. The section support 1030 has a first leg 1032A and a second leg 1032B and a crossbar 1034 that couples to the first leg 1032A and the second leg 1032B. The section support 1030 is hingedly coupled to the first section frame 1004 via a first hinge and a second hinge.

The second section frame 1006 has a first crossbar 1040A, a second crossbar 1040B, a first longitudinal bar 1042A, and a second longitudinal bar 1042B. The first extension bar 1028A and the second extension bar 1028B are attached to outer portions of the first crossbar 1040A and the second crossbar 1040B, respectively, are coupled at one end to joints (or "hinges") discussed above. The second section frame 1006 is hingedly coupled at first and second hinges to one or more of the legs of the base frame 1002.

Figure 6:
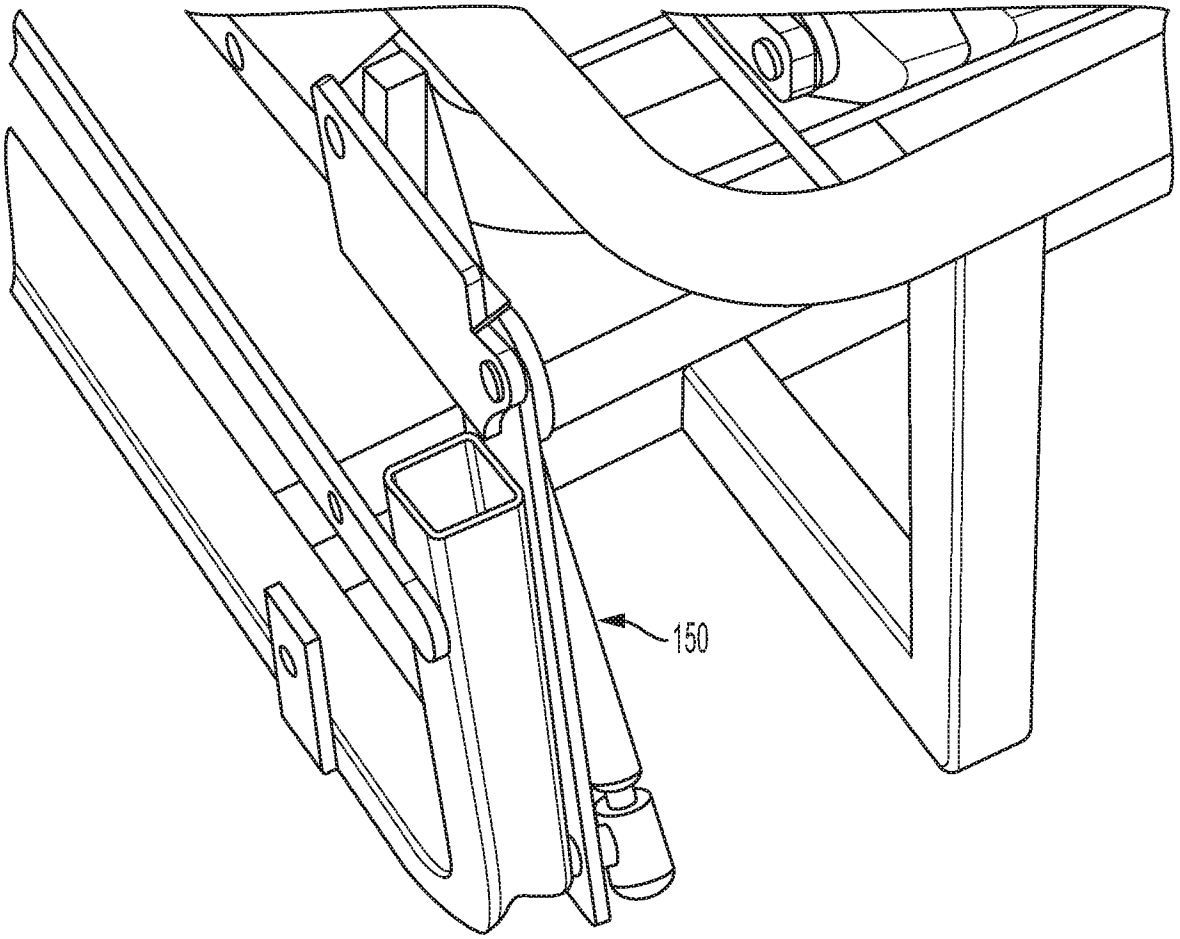
FIG. 6 shows a perspective view of a bottom portion of the sofa bed of FIG. 3 in the sofa configuration.

The sofa bed 1000 include a spring 1050 that is coupled to one of the legs of the base frame 1002 and the first extension bar 1028A such that the spring 1050 applies force to the first extension bar 1028A (and thus the second section frame 1006) when the second section frame 1006 is in certain positions or configurations, as will be discussed in further detail below. In one embodiment, the spring 1050 is rotatably coupled to the first leg 1010A and the first extension bar 1028A so that the spring 1050 can rotate while the sofa bed 1000 switches between the sofa position (see FIG. 3 and FIG. 6) and the bed position (see FIG. 5). The spring 1050 can be a compression spring and more specifically a gas compression spring. Alternatively, the spring 1050 can be any known spring or other apparatus for applying force to urge the second section frame 1006 from the sofa configuration into the bed configuration and vice versa.

The third section frame 1008 has a first crossbar 1060A, a second crossbar 1060B, a first longitudinal bar 1062A, a second longitudinal bar 1062B, a first connection plate 1064A, and a second connection plate 1064B. The first connection plate 1064A and the second connection plate 1064B are hingedly coupled to the first crossbar 1060A and the second crossbar 1060B, respectively, and extend toward the base frame 1002.

In use, the sofa bed 1000 can be altered or moved by a user between a sofa configuration and a bed configuration by moving the first section frame 1004, the second section frame 1006, and the third section frame 1008 as described herein. In the sofa configuration as shown in FIG. 3, the first section frame 1004 (when used in conjunction with a cushion 1070A) is used as a seat of the sofa bed 1000 while the third section frame 1008 (when used with a cushion 1070B) used as a back of the sofa bed 1000. The sofa bed 1000 is switched to the bed configuration by a user lifting the first section frame 1004 and urging the first section frame 1004 to rotate with respect to the base frame 1002 around hinges. As the user urges the first section frame 1004 upward and forward, the second section frame 1006 is also urged upward and rotates with respect to the base frame 1002 around hinges to allow the second section frame 1006 to move upward away from the base frame 1002.

The compression spring 1050 assists with the upward movement of the second section frame 1006. That is, the compression force created by the compression spring 1050 results in the compression spring 1050 applying an upward force on the first extension bar 1028A when the second section frame 1006 is in the sofa configuration. More specifically, in the sofa configuration, the compression spring 1050 is in its most compressed state. Thus, when the sofa bed 1000 is in the sofa configuration, the compression spring 1050 is applying the greatest amount of upward force on the first extension bar 1028A (and hence the second section frame 1006). Thus, the compression spring 1050 reduces the amount of force that must be applied by the user.

As force applied by the user and the compression spring 1050 cause the second section frame 1006 to continue to rotate around the hinges, the first section frame 1004 and the second section frame 1006 extend forward away from the base frame 1002 toward the bed configuration of FIG. 5. As the first section frame 1004 and the second section frame 1006 move into the bed configuration, the compression spring 1050 rotates into its bed position such that, again, the compression spring 1050 is in its most compressed state. Thus, when the user moves the sofa bed 1000 back into the sofa configuration, the compression spring 1050 applies upward force to the first extension bar 1028A (and thus the second section frame 1006), thereby assisting the user by reducing the amount of force necessary for the user to apply to move the first section frame 1004 and the second section frame 1006 from the bed configuration into the sofa configuration. Further, as the first section frame 1004 and the second section frame 1006 extend forward to the bed configuration, the deployable section support 1030 can be automatically urged to rotate at its hinges to begin deploying to its extended or deployed position.

Once the first section frame 1004 and the second section frame 1006 are moved fully into their positions for the bed configuration, the user then urges a top portion of the third section frame 1008 forward such that the third section frame 1008 rotates on its joints until it is positioned in its bed configuration. At that point, the first section frame 1004, the second section frame 1006, and the third section frame 1008 are positioned adjacent to each other such that top surfaces of cushions are aligned with each other in the bed configuration, resulting in a uniformly flat top surface. As with all the embodiments disclosed or contemplated herein, the uniformly flat surface results from cushions on all three sections having substantially similar or uniform thickness and substantially similar or uniform cushion consistency or pliability across the sections. For example, the cushions on all three sections that form the flat surface of the bed configuration are made from polyethylene foam, visco-elastic foam (memory foam), latex foam, or densified fiber matting. Alternatively, the cushions can be made from any known material for use in sofa cushions or mattresses. Further, in certain embodiments, the cushions all have a substantially similar thickness ranging from about 2 inches to about 8 inches. Alternatively, the thickness can range from about 4 inches to about 6 inches.

Although the present invention has been described with reference to preferred embodiments, persons skilled in the art will recognize that changes may be made in form and detail without departing from the spirit and scope of the invention. While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

What is claimed is:

1. A sofa bed configured to be switched between a sofa configuration and a bed configuration, the sofa bed comprising:

a base frame;

a middle frame coupled to the base frame and configured to be rotated between a first position in the sofa configuration and a second position in the bed configuration, wherein the middle frame is configured to rotate substantially 180 degrees between the first position and the second position;

a seat-and-foot frame rotatably coupled to the middle frame;

a back-and-head frame rotatably coupled to the base frame; and a gas compression spring coupled between the middle frame and the base frame and configured to urge the middle frame to switch from the sofa configuration to the bed configuration and also from the bed configuration to the sofa configuration.

2. The sofa bed of claim 1, wherein the gas compression spring is configured to be in a most compressed state in both the sofa configuration and the bed configuration.

3. The sofa bed of claim 1, wherein the gas compression spring is arranged to become less compressed when the middle frame is between the sofa configuration and the bed configuration as the middle frame rotates from the sofa configuration and also from the bed configuration.

4. The sofa bed of claim 1, wherein the back-and-head frame is rotatable between an upright position in the sofa configuration and a down position in the bed configuration.

5. The sofa bed of claim 4, wherein the back-and-head frame is configured to rotate greater than 90 degrees between the upright position and the down position.

6. The sofa bed of claim 1, wherein the middle frame, the seat-and-foot frame, and the back-and-head frame are substantially parallel to each other in the bed configuration, and wherein the back-and-head frame is not parallel to the middle frame in the sofa configuration.

7. The sofa bed of claim 1, wherein the seat-and-foot frame is coupled to a deployable section support member.

8. The sofa bed of claim 7, wherein the deployable section support member is rotatably coupled to the seat-and-foot frame.

9. A sofa bed configured to be switched between a sofa configuration and a bed configuration, the sofa bed comprising:

a base frame;

a middle frame rotatably coupled to the base frame;

a seat-and-foot frame rotatably coupled to the middle frame;

a back-and-head frame rotatably coupled to the base frame; and a spring connected at one end to the base frame and connected at the other end to the middle frame and arranged to be compressed in both the sofa configuration and the bed configuration, wherein the spring is arranged to initially become less compressed and then more compressed when the middle frame is between the sofa configuration and the bed configuration as the middle frame rotates from the sofa configuration and from the bed configuration.

10. The sofa bed of claim 9, wherein the spring is a gas compression spring.

11. The sofa bed of claim 9, wherein the middle frame is at a first position in the sofa configuration and a second position in the bed configuration, wherein the middle frame is configured to rotate substantially 180 degrees between the first position and the second position.

12. The sofa bed of claim 11, wherein the middle frame and the seat-and-foot frame are substantially parallel to each other in both the sofa configuration and the bed configuration.

13. The sofa bed of claim 12, further comprising:

a first cushion coupled to the middle frame, a second cushion coupled to the seat-and-foot frame, and a third cushion coupled to the back-and-head frame.

14. The sofa bed of claim 13, wherein in the bed configuration, the first cushion, the second cushion, and the third cushion form a level sleeping surface.

* * * * *